US007081874B2

(12) United States Patent
Rivera-Cintron et al.

(10) Patent No.: US 7,081,874 B2
(45) Date of Patent: Jul. 25, 2006

(54) PORTABLE DISPLAY DEVICE AND METHOD UTILIZING EMBEDDED STILL IMAGE BUFFER TO FACILITATE FULL MOTION VIDEO PLAYBACK

(75) Inventors: Carlos Rivera-Cintron, Lake Worth, FL (US); Daniel Baudino, Lake Worth, FL (US)

(73) Assignee: Motorola, Inc., Schaumburg, IL (US)

( * ) Notice: Subject to any disclaimer, the term of this patent is extended or adjusted under 35 U.S.C. 154(b) by 215 days.

(21) Appl. No.: 10/324,677

(22) Filed: Dec. 20, 2002

(65) Prior Publication Data

US 2004/0119670 A1 Jun. 24, 2004

(51) Int. Cl.
*G09G 3/36* (2006.01)

(52) U.S. Cl. ..... 345/87; 345/91; 345/95; 345/96; 345/100

(58) Field of Classification Search ..... 345/87, 345/95, 96, 100, 32, 92, 91, 7–8, 419–437, 345/716–726, 737–744, 690, 848, 854, 204, 345/506, 205; 382/100, 103; 257/200; 386/46; 348/158, 36, 231.99, 42, 51–59, 14.06, 14.09, 348/14.05; 359/474, 477; 438/30, 28; 352/244
See application file for complete search history.

(56) References Cited

U.S. PATENT DOCUMENTS 5,289,577 A * 2/1994 Gonzales et al. ..... 345/506
5,319,447 A * 6/1994 Garino et al. ..... 348/708
5,668,469 A * 9/1997 Natori et al. ..... 324/121 R
6,177,958 B1 * 1/2001 Anderson ..... 348/362
6,232,937 B1 * 5/2001 Jacobsen et al. ..... 345/87
6,411,725 B1 * 6/2002 Rhoads ..... 382/100
6,437,818 B1 * 8/2002 Ludwig et al. ..... 348/14.09
6,545,654 B1 * 4/2003 Jacobsen et al. ..... 345/87
6,582,980 B1 * 6/2003 Feldman et al. ..... 438/28
6,677,981 B1 * 1/2004 Mancuso et al. ..... 348/36
6,738,514 B1 * 5/2004 Shin et al. ..... 382/187
6,842,219 B1 * 1/2005 Lee ..... 352/244
2001/0015709 A1 * 8/2001 Imajo et al. ..... 345/87
2002/0080103 A1 * 6/2002 Choi ..... 345/87
2002/0140829 A1 * 10/2002 Colavin et al. ..... 348/231.99
2002/0142504 A1 * 10/2002 Feldman et al. ..... 438/30
2002/0154102 A1 * 10/2002 Huston ..... 345/204
2003/0043260 A1 * 3/2003 Yap et al. ..... 348/14.06
2003/0117585 A1 * 6/2003 Lee ..... 352/244
2004/0059933 A1 * 3/2004 Levy ..... 713/200
2004/0124442 A1 * 7/2004 Koyama ..... 257/200
2004/0156616 A1 * 8/2004 Strub et al. ..... 386/46

* cited by examiner

*Primary Examiner*—Bipin Shalwala
*Assistant Examiner*—Prabodh Dharia
(74) *Attorney, Agent, or Firm*—Vedder, Price, Kaufman & Kammholz, P.C.

(57) ABSTRACT

A portable display device (10) includes an LCD display module (12) that includes an embedded still image buffer (16), and external processing circuitry (24) and associated processor memory (22), wherein the processor memory (22) receives decoded motion video (30) as pixel data from a video decoder (216), while the data from the embedded still image memory is displayed on an LCD display (14). When a completely decoded frame of video is stored in the memory, the processing circuitry (24) turns an external pixel transfer clock signal (19) on and transfers the decoded frame (21) from the memory (22) to the embedded image buffer (16) in the LCD display module (12). When the transfer of the decoded frame (21) is complete, an end of frame indication signal (236) is generated and the processing circuitry (24) turns off the external pixel transfer clock signal (19) to the LCD display module (12).

13 Claims, 4 Drawing Sheets

PORTABLE DISPLAY DEVICE AND METHOD UTILIZING EMBEDDED STILL IMAGE BUFFER TO FACILITATE FULL MOTION VIDEO PLAYBACK

FIELD OF THE INVENTION

The invention relates generally to portable display devices and more particularly to portable display devices and methods that employ LCD display modules that include an LCD display and an embedded still image buffer.

BACKGROUND OF THE INVENTION

Portable display devices, such as cell phones, personal digital assistants (PDA's), or other hand held devices may employ an LCD display module, also referred to as a "smart LCD panel" such as those used in digital cameras and other devices. Such LCD display modules contain an embedded full frame memory, also referred to as an embedded still image buffer, which stores a single frame of digital data that is for display on an LCD display, also incorporated in the same package as the embedded still image buffer.

Portable display devices, such as cell phones or other suitable display devices increasingly attempt to provide additional functionality in the form of displaying full motion video. However, it is also important to employ efficient and display low cost solutions to facilitate this functionality. The LCD display module typically operates in two modes. One mode sometimes referred to as still frame mode, is used to store a single still frame of video such as a photograph or other suitable still image wherein the embedded still image buffer stores the digital data that is displayed as a still image on the LCD display. In a second mode, referred to as moving image mode, the embedded still image buffer is not employed, but instead manufactures of LCD display modules typically require another device that interfaces with the LCD display module to include a plurality of buffers so that external RAM must be included in the device or chip set that is coupled to the LCD display module when moving images are to be displayed. The requirement of additional RAM, typically in the form of a plurality of different frame buffers, adds cost and requires the use of scarce real estate, particularly when the portable display device is hand held portable display devices. As such, in typical portable display devices that employ LCD display modules, the embedded still image buffer (frame memory) is not used to display moving images and instead is typically only used in the still image mode of the LCD display module.

In addition when employing the moving image mode and hence the additional external RAM required for the moving image mode, a number of problems can arise related to video playback. For example, to facilitate a tradeoff between cost and performance, single display memories may be used in the moving image mode which can reduce the video playback quality since the single display memory may not be large enough for resolutions desired and may reduce video playback quality depending on the rate and efficiency of the video decoding. In addition, high current consumption occurs for example when displaying data on the LCD display. For portable display devices, reduction in current draw can greatly increase battery life. With the increase in demand for motion video playback on portable devices, such as the video playback of encoded video such as MPEG IV encoded video streams or other suitable video streams, it would be desirable to provide a cost effective solution to display motion video using conventional LCD display modules.

DETAILED DESCRIPTION OF THE DRAWINGS

The invention will be more readily understood with reference to the following drawings wherein like reference numerals represent like elements and wherein.

DETAILED DESCRIPTION OF A PREFERRED EMBODIMENT

Briefly, a portable display device includes an LCD display module that includes an embedded still image buffer, and external processing circuitry and associated processor memory, wherein the processor memory receives decoded motion video as pixel data from a video decoder, while the data from the embedded still image memory is displayed on an LCD display. When a completely decoded frame of video is stored in the memory, the processing circuitry turns an external pixel transfer clock signal on and transfers the decoded frame from the memory to the embedded image buffer in the LCD module. When the transfer of the decoded frame is complete, an end of frame indication signal is generated and the processing circuitry turns off the external pixel transfer clock signal to the LCD display module so that decoding of the next frame of encoded motion video can be placed in the external processor memory (external from the LCD display module). The processing circuitry maintains synchronization of the external buffer and the embedded still image buffer to improve video playback quality and the processing circuitry turns off the external pixel transfer clock signal whenever incoming and encoded video data is decoded, to save power. In addition, using the LCD display module in its still image mode (e.g. the embedded still image buffer) to effect display of full motion video also reduces the amount of external memory needed by the external processing circuitry. The external pixel transfer clock signal is strobed faster than the video is decoded to provide suitable frame delivery.

A method for displaying motion video on a portable display device is also disclosed that includes keeping the external pixel transfer clock signal off, while storing decoded video information in a memory external to the LCD display module, turning the external pixel transfer clock signal on, in response to a frame of decoded motion video being available in the external processor memory, transferring the decoded frame from the external memory to the embedded still image buffer in the LCD display module, generating an end of frame indication signal, indicating that the decoded frame has been transferred to the embedded still image buffer, and turning off the external pixel clock signal to the LCD display module. The above steps are repeated at a frame rate to effect moving video images from the embedded still image buffer.

Figure 1:
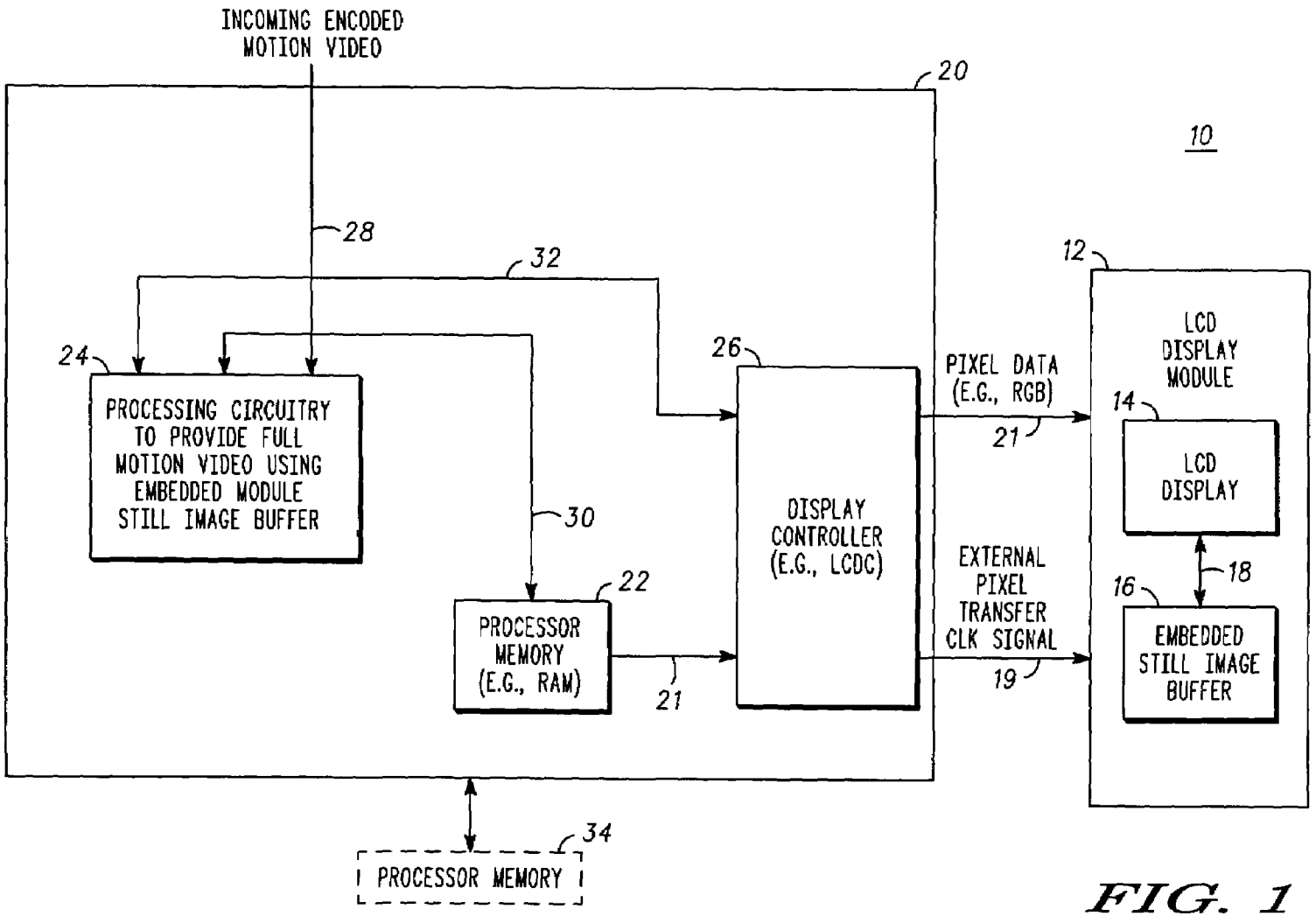
FIG. 1 is a block diagram illustrating one example of a portable display device in accordance with one embodiment of the invention.

FIG. 1 is a block diagram illustrating one example of a portable display device 10 in accordance with one embodiment of the invention. The portable display device 10 may be, but is not limited to, a cellular telephone, PDA, or other suitable wireless hand held device or non-wireless hand held device. A portable display device 10 may therefore include other circuitry not shown, including, but not limited to, radio telephone transceiver circuitry or any other suitable communication circuitry as desired. The portable display device 10 includes an LCD display module 12, as known in the art, that include for example an LCD display 14 and an embedded still image buffer 16 that is embedded within the display module 12 packaging an associated circuitry (not shown). One example of the LCD display module 12 may be a Sanyo LC13005 display, sold by Sanyo Electric Co., Ltd., or other suitable display. The embedded still image buffer 16 may be any suitable size but may be, for example, 12×176×220 bits or any other suitable size. The LCD display 14 and embedded still image buffer 16 are suitably coupled through a link 18. The display module 12 may include other logic (not shown) to facilitate the outputting of digital data stored in the still image buffer 16 onto the LCD display 14. The embedded still image buffer 16 is preferably sized to contain enough data for a single frame of still image data that is to be displayed on the LCD display 14. The embedded still image buffer 16 is the image buffer used during the still image mode of the LCD display module 12.

The LCD display module displays contents of the embedded still image buffer 16 as an image frame on the LCD display 14, and is responsive to an external pixel transfer clock signal 19 (the signal 19 can also include Hsync and Vsync control signals which are also turned off when the clock signal is turned off) that controls transfer of a decoded frame 21 (i.e., pixel data) into the embedded still image buffer 16. The external pixel transfer clock signal 19 is external to the LCD display module 12 since it is generated by the display controller 26.

The portable display device 10 also includes a processor 20 external to the LCD display module 12, such as microcontroller unit (MCU) or any other suitable logic, chip, chip set, or any other suitable combination of hardware, software or firmware as desired. In this example, the processor 20 includes processor memory 22, such as RAM which may be, for example, at least equal to or greater than the embedded still image 16, processing circuitry 24 that provides full motion video using the embedded still image buffer 16, and a display controller 26, such as an LCD controller. The processing circuitry 24 may be any suitable logic circuitry or any suitable combination of hardware, software and firmware. The processing circuitry 24 receiving incoming encoded motion video 28 such as one or more MPEG IV streams, or any other suitable encoded motion video and outputs sequentially decoded motion video 30 (sequential frames) for storage in processor memory 22. Hence, the processor memory 22 is operatively coupled to the processing circuitry 24 through one or more suitable buses to receive the decoded motion video 30 as pixel data from a video decoder within the processing circuitry 24. Also, the processor 20 sets the LCD display modules in still image mode using one or more mode commands sent via a one way command bus (not shown).

The processing circuitry 24 sends and receives control data 32 to control the display controller 26 to transfer and output the decoded frame 21 that was stored in processor memory 22. The processing circuitry 24 effects moving video images from the embedded still image buffer 16 by using the processor memory 22 during the decoding process to store decoded video, while the embedded still image buffer is displaying a frame on the LCD display. The display controller 26 controls the transfer of a frame of decoded motion video 21 to be stored in the embedded still image buffer 16, and subsequently output to the LCD display 14 at a rate so that the images appear to be moving to a user of the portable display device 10. Hence, the still image buffer 16 is controlled to effect motion video, among other advantages. The external pixel transfer clock signal 19 is strobed at a rate faster than the rate at which a frame is decoded.

The processor memory 22 may be on the same chip or in the same package as processor 20 as shown, but may also be external to the packaging that contains processor 20 as shown by dash lines 34. In any event, the processor memory 22 is considered external or non-embedded buffer memory, since it is not embedded in the LCD display module 12.

In operation, the processor 20 keeps the external pixel transfer clock signal 19 off while the processor memory 22 receives decoded video information 30. This may occur while the embedded still image buffer 16 is displaying contents on the LCD display. The processor 20 keeps the external pixel transfer clock signal off, for example, until a complete frame of decoded motion video is available from the processor memory 22. This may be indicated through suitable control data 32 to display controller 26 as further described below. Once a complete frame of decoded motion video is available from the processor memory 22, the processor 20 turns the external pixel transfer clock signal 19 on, which causes the transfer of a decoded frame from the processor memory 22 to the embedded still image buffer 16 in the LCD display module 12. Once the entire decoded frame has been transferred, the processor 20 turns off the external pixel transfer clock signal 19 to the LCD display module. These steps are repeated for additional incoming decoded video frames at a rate to effect the appearance of moving video images on the LCD display 14 from the embedded still image buffer 16.

Preferably, the processor memory 22 is partitioned to store the decoded video 30 in one portion and graphic information associated with a graphic user interface in another portion such that the different portions may be updated at different points in time. The processor memory 22 is thereof split into two logical parts, a GUI area and image decoding area. An example will be described in more detail with respect to FIG. 4.

Figure 2:
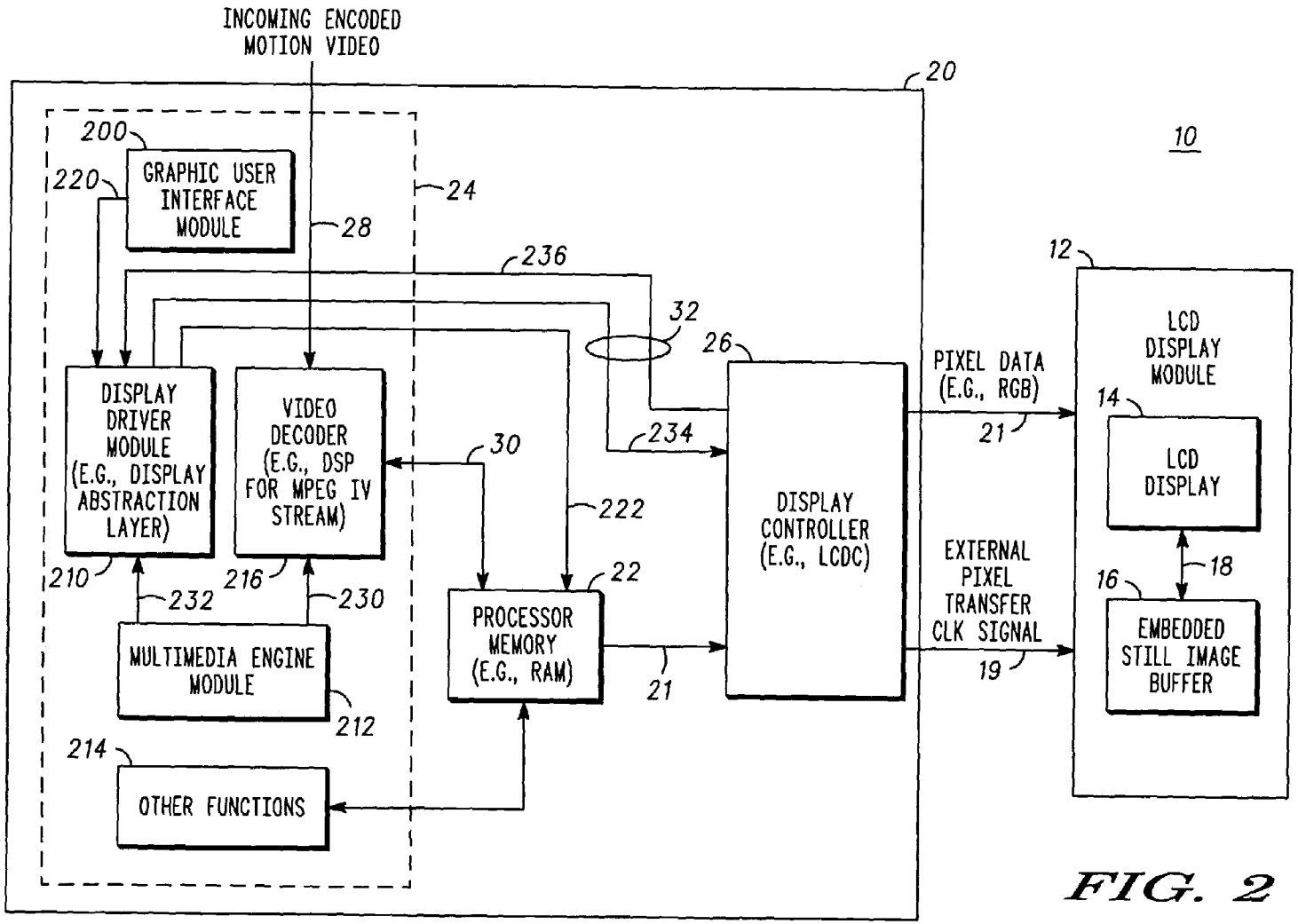
FIG. 2 is a block diagram illustrating a more detailed example of a portable display device in accordance with one embodiment of the invention.

FIG. 2 illustrates a more detailed example of one embodiment of the processor 20 in accordance with one embodiment of the invention. The processing circuitry 24 includes memory such as ROM, RAM or any other suitable memory, that stores a plurality of software modules, as executable instructions such that one or more processing devices (e.g. CPU, DSP, or other processing device) when executing the software modules performs the operations as described herein. In this particular example, the memory includes executable instructions in the form of a graphic user interface module 200, a display driver module 210, a multimedia module 212 and any other suitable function modules 214 as desired. The processing circuitry 24 also includes a video decoder, 216 such as a digital signal processor or any other suitable control logic, software, hardware or firmware or any other suitable combination thereof to effect decoding of the incoming encoded motion video 28. In this example, the video decoder 216 may be a DSP that performs MPEG4 decoding.

The graphic user interface module 200 may be any suitable graphic user interface application or other software, that presents, for example, graphic information to a user on the LCD display 14 and also receives input from a user in response to displayed graphics. Hence, the graphic user interface module 200 is shown to produce graphics information 220 which is provided to the display module driver 210 which effectively copies the GUI information 220 to the processor memory 22. The GUI information 220 is shown from the driver as information 222. Hence, any time when the graphic user interface module updates the graphic user interface, the graphics information 220 is stored in the processor from a 222 under control of the display driver 210.

The display driver module 210 may be implemented, for example, display abstraction layer or any other suitable layer or software module. The multi-media engine 212 or other suitable software module starts the decoding of a video frame based on the incoming encoded motion video 28 and hence, generates video decoding control data 230 to the video decoder to, for example, initiate the decoding process. In addition, the multi-media engine module 212 notifies the display driver module 210 through a decoded frame ready signal 232 that a complete decoded frame is available in the processor memory 22. The multi-media engine module 212 causes the decoded motion video 30 to be output by the video decoder 216 to the processor memory 22. The decoded video data is representative as decoded frame 21.

It will be understood as used herein, the term "signal" may be digital information and/or analog information as desired. The display driver module 210 generates control data 32, in this example, frame ready data 234 to the display controller 26. The frame ready data 234 represents that a decoded frame of video is available in the processor memory 22 for display. Thus, control data 32 is generated by the display driver module 210 in response to the decoded frame ready signal 232.

The display controller 26 generates an end of frame indication signal 236 to the display driver module 210 indicating that the display controller 26 has successfully transferred the decoded frame 21 to the embedded still image buffer 16.

Figure 3:
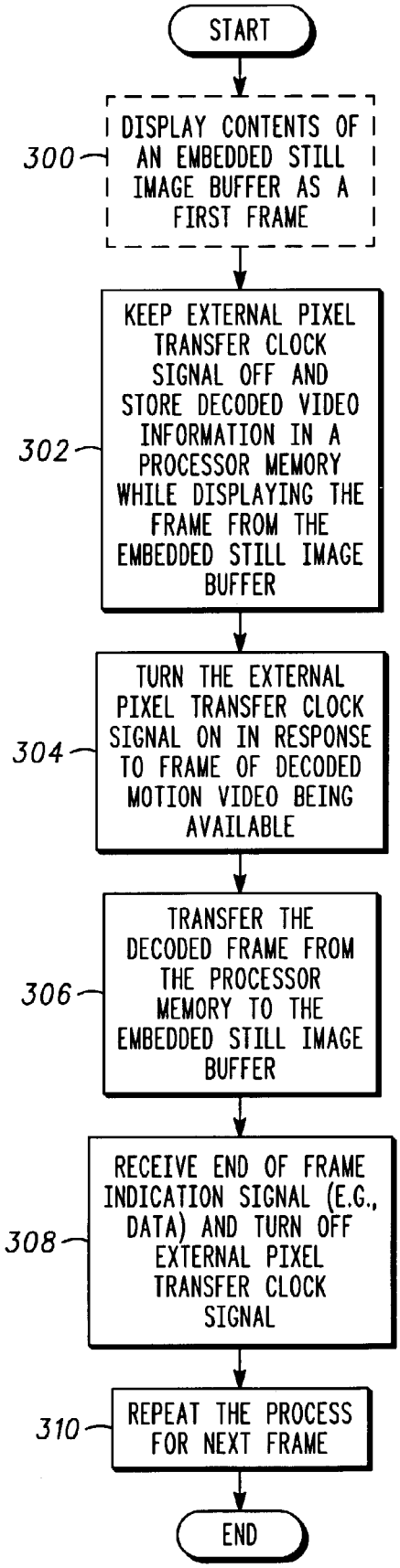
FIG. 3 is a flow chart illustrating one example of a method for displaying motion video on a portable display device in accordance with one embodiment of the invention.

Referring to FIGS. 2 and 3, the operation of the portable display device 10 will be described. FIG. 3 is a flow chart representing one example of a method for displaying motion video using an embedded still image buffer of a LCD display module that is set in a still image mode. As shown in block 300, if desired, the contents of the embedded still image buffer 16 may be displayed on the LCD display 14 while the processor 20 receives encoded motion video. This is done automatically by the LCD display module. However, the display of the contents may not occur until a complete frame of decoded video is provided to the still image buffer. The LCD controller 26 controls the external pixel transfer clock signal 19 to the embedded still image buffer 16 in response to the control data 32. As shown in block 302, the display driver module 210 keeps the external pixel transfer clock signal 19 off via control data 234 and the video decoder 216 stores decoded video 30 in the processor memory 22 while the embedded still image buffer 16 displays its contents on the LCD display.

As shown in block 304, the method includes turning the external pixel transfer clock on in response to a frame of decoded motion video being available from the processor memory 22. This is determined by the display driver module 210 upon receiving the data 232 from the multi-media engine module 212 that detects that a completed frame of decoded video is available in the processor memory 22. In response thereto, the control data 234 notifies the LCD controller 26 to turn on the external pixel transfer signal 19 and transfer the decoded frame 21 from the processor memory 22 to the embedded still image buffer 16 in the LCD display module 12. When the display controller 26 completes the transfer of an entire frame from the processor memory 22 to the embedded still image buffer 16, the display controller 26 generates the end of frame indication signal 236 which is detected by the display driver module 210. The display driver module 210 then generates control data 234 to notify the display controller 26 to turn off the external pixel transfer clock 19. The process is repeated until no more encoded frames are received.

Hence, the multi-media engine module 212 generates data 230 to control the video decoder to decode incoming decoded video data 28 and also sends frame ready data 234 to the display driver module 210, that represents a decoded frame of video and available in the processor memory 22 for display. The display driver module generates control data 234 for the LCD controller 26 to turn the external pixel transfer clock signal 19 on in response to the frame ready data 232.

As such, as shown in block 306, method includes transfer of decoded frame 21 from the processor memory 22 to the embedded still image buffer 16 and after completion of the transfer, receiving, such as by the display driver module 210, and end of frame indication signal 236 from the display controller 26. In response to the end of frame indication signal 236, the display driver module 210 notifies a display controller to turn off the external transfer clock signal 19. This is shown in block 308. It will also be recognized that the display controller 26 upon detection of a completion of a transfer of the entire frame, automatically turns off the external pixel transfer clock without sending the end of frame indication signal 236. Other variations will also be apparent to those of ordinary skill in the art. As shown in block 310, the process is repeated for a next decoded frame.

Figure 4:
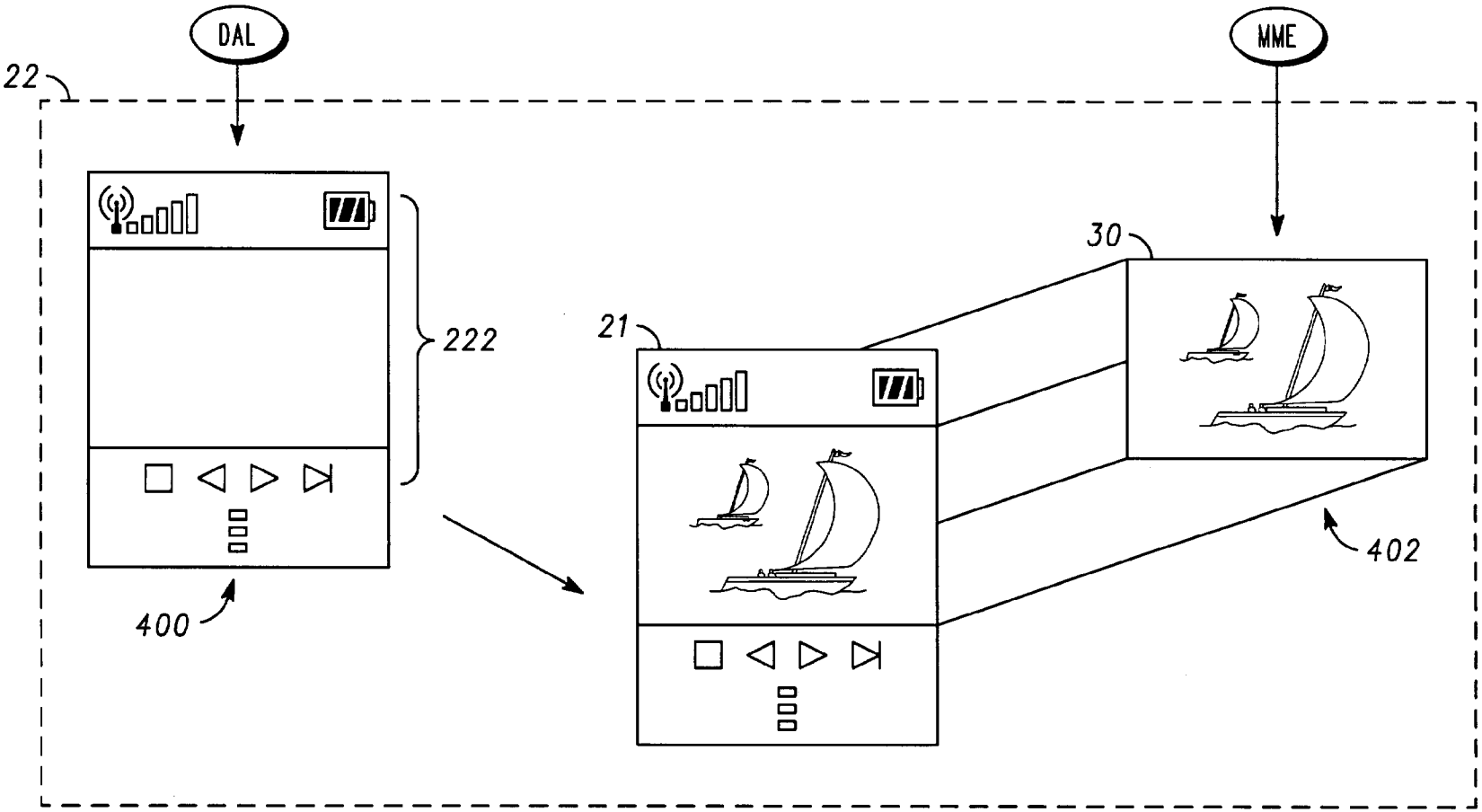
FIG. 4 is a diagram illustrating one example of partitioned external memory in accordance with one embodiment of the invention.

FIG. 4 diagrammatically illustrates a portioned processor memory containing the GUI information 220, the decoded frame 21 and the decoded video data 30 to indicate that the processor memory 22 is split into two logical parts, a GUI area indicated at 400 and an image decoding area indicated at 402. The combined parts make up the entire decoded frame 21.

As such, the above portable display device and methods employ an LCD display module set in a still image mode and use video playback components that decode a frame in an external memory. The portable display device and methods turn on the external pixel transfer clock signal when there is a completely decoded frame in the processor memory and turns off the external pixel transfer clock signal whenever the video decoder starts decoding a new frame in the processor memory. The synchronization of the processor memory and the embedded still image buffer is achieved by the operations described above. Turning off the external pixel transfer clock signal (and Hsync and Vsync signals) whenever data is being decoded can save power while using the embedded still image buffer in the still image mode of the LCD display module can reduce the amount of external memory (processor memory) that needs to be employed for the processor when compared to an external dual buffer approach. Other advantages will be recognized by those of ordinary skill in the art.

The above detailed description of the invention and the examples described therein have been presented for the purposes of illustration and description. It is therefore contemplated that the present invention cover any and all modifications, variations or equivalents that fall within the spirit and scope of the basic underlying principles disclosed above and claimed herein.

What is claimed is:

1. A portable display device comprising:

an LCD display module that includes:

at least an LCD display, and embedded still image buffer, operatively coupled to the LCD display, and that displays contents of the embedded still image buffer as an image frame on the LCD display wherein the embedded still image buffer is operatively responsive to an external pixel transfer clock signal that controls transfer of pixel data into the embedded still image buffer;

first memory that receives decoded motion video as pixel data from a video decoder;

processing circuitry, operatively coupled to the memory and to the LCD module, that is operative to:

(a) keep the external pixel transfer clock signal off while the memory receives decoded video information, (b) turn the external pixel transfer clock signal on in response to a frame of decoded motion video being available from the memory;

(c) transfer the decoded frame from the memory to the embedded still image buffer in the LCD display module;

(d) generate an end of frame indication signal indicating that transfer of the decoded frame is complete and turn off the external pixel transfer clock signal to the LCD display module; and (e) repeat (a)–(d) at a frame rate to effect moving video images from the embedded still image buffer.

2. The portable display device of claim 1 wherein the first memory is partitioned to store the decoded video in one portion and graphic information associated with a graphic user interface in another portion.

3. The portable display device of claim 1 wherein the processing circuitry generates frame ready data representing that a decoded frame of video is available in the memory for display.

4. The portable display device of claim 1 wherein the processing circuitry includes one or more processors and second memory containing executable instructions stored therein that when executed by the one or more processors causes the one or more processors to carry out steps (a)–(e).

5. A portable display device comprising:

an LCD display module that includes:

at least an LCD display, and embedded still image buffer, operatively coupled to the LCD display, and that displays contents of the embedded still image buffer as an image frame on the LCD display wherein the embedded still image buffer is operatively responsive to an external pixel transfer clock signal that controls transfer of pixel data into the embedded still image buffer;

first memory that receives decoded motion video as pixel data from a video decoder;

processing circuitry, operatively coupled to the memory, that provides control data;

an LCD controller, operatively responsive to the control data and operatively coupled to the LCD display module, the processing circuitry and to the memory, and operative to provide the pixel data to the LCD display module and to control the external pixel transfer clock signal to the embedded still image buffer in response to the control data;

such that the processing circuitry generates control data to:

(a) keep the external pixel transfer clock signal off while the first memory receives decoded video information;

(b) turn the external pixel transfer clock signal on in response to a frame of decoded motion video being available from the first memory;

(c) cause the LCD controller to transfer the decoded frame from the memory to the embedded still image buffer in the LCD display module;

and wherein the processing circuitry:

(d) receives an end of frame indication signal from the LCD controller and causes the LCD controller to turn off the external pixel transfer clock signal to the LCD display module.

6. The portable display device of claim 5 wherein the first memory is partitioned to store the decoded video in one portion and graphic information associated with a graphic user interface in another portion.

7. The portable display device of claim 5 wherein the control data includes frame ready data representing that a decoded frame of video is available in the memory for display.

8. The portable display device of claim 5 wherein the processing circuitry includes one or more processors and second memory containing executable instructions stored therein that when executed by the one or more processors causes the one or more processors to carry out steps (a)–(e).

9. The portable display device of claim 8 wherein the executable instructions stored in the second memory include at least a graphic user interface (GUI) module, a multimedia engine module and a display driver module wherein the display driver module causes graphics information from the GUI module to be stored in the first memory and causes the control data to be sent to the LCD controller and wherein the multimedia engine module generates data to control the video decoder to decode incoming encoded video data and sends frame ready data representing that a decoded frame of video is available in the first memory for display and the display driver module generates the control data for the LCD controller to turn the external pixel transfer clock signal on in response to the frame ready data.

10. A method for displaying motion video on a portable display device that includes an LCD display module having an LCD display and an embedded still image buffer that is operatively responsive to an external pixel transfer clock signal, comprising:

(a) keeping the external pixel transfer clock signal off while storing decoded video information in a first memory while displaying contents of the embedded still image buffer on the LCD display and until a frame of decoded motion video is available from the first memory, (b) turning the external pixel transfer clock signal on in response to a frame of decoded motion video being available from the first memory;

(c) transferring, in response to step (b), the decoded frame from the first memory to the embedded still image buffer in the LCD display module;

(d) generating an end of frame indication signal and turning off the external pixel transfer clock signal to the LCD display module in response to the end of frame indication signal; and (e) repeating the steps of (a)–(d) at a frame rate to effect moving video images from the embedded still image buffer.

11. The method of claim 10 including displaying, on the LCD display, contents from the embedded still image buffer while storing decoded video information in the first memory.

12. A method for displaying moving images on a handheld electronics device, comprising:

sequentially decoding frames of encoded motion video;

storing each decoded frame of motion video after decoding in a memory device;

transferring each decoded frame of motion video, stored in the memory device, to an embedded still image buffer of an LCD display module; and displaying each frame of decoded motion video transferred to the embedded still image buffer on an LCD display of the LCD display module.

13. The method of claim 12, transferring each decoded frame of motion video, stored in the memory device, with an external pixel transfer clock signal, and disabling the external pixel transfer clock signal when not transferring decoded motion video frames to the embedded still image buffer.

* * * * *